US011196218B1

(12) United States Patent
Su et al.

(10) Patent No.: US 11,196,218 B1
(45) Date of Patent: Dec. 7, 2021

(54) CONNECTOR WITH DIRECT LOCKING AND ROTATIONAL PRE-EJECTION FUNCTION

(71) Applicant: NEXTRONICS ENGINEERING CORP., New Taipei (TW)

(72) Inventors: Hou-An Su, Keelung (TW); Frank Hsu, New Taipei (TW); Wen-Feng Xie, Guangzhou (CN); Can-Hui Liang, Guangzhou (CN); Liang-Ju Liang, Guangzhou (CN); Yong Zhang, Guangzhou (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 17/035,717

(22) Filed: Sep. 29, 2020

(30) Foreign Application Priority Data

Jul. 15, 2020 (CN) ..... 202010679930.X

(51) Int. Cl.
*H01R 13/62* (2006.01)
*H01R 13/639* (2006.01)
*H01R 13/635* (2006.01)

(52) U.S. Cl.
CPC ..... *H01R 13/639* (2013.01); *H01R 13/635* (2013.01)

(58) Field of Classification Search
CPC ..... H01R 13/639; H01R 13/635
USPC ..... 439/153, 155, 160
See application file for complete search history.

(56) References Cited

U.S. PATENT DOCUMENTS 2,051,425 A * 8/1936 Schlums ..... H01R 13/631 439/160
2,134,345 A * 10/1938 Sheeran ..... H01R 13/633 439/160
2,161,353 A * 6/1939 Hummel ..... H01R 13/633 439/160
2,430,011 A * 11/1947 Gillentine ..... H01R 13/633 439/160
2,688,734 A * 9/1954 Welling ..... H01R 13/635 439/159
2,696,594 A * 12/1954 Harrington ..... H01R 13/633 439/160
2,955,273 A * 10/1960 Winkler ..... H01R 13/635 439/153

(Continued)

*Primary Examiner* — Neil Abrams
(74) *Attorney, Agent, or Firm* — Li & Cai Intellectual Property Office

(57) ABSTRACT

A connector with a direct locking and a rotational pre-ejection function is provided. The connector includes an insulated body, a plurality of terminals, an inner shell, an outer shell, a fastener, an ejector, a first elastic element, and a second elastic element. A plurality of push blocks are disposed in the outer shell, the ejector has a plurality of slope surfaces, and the push blocks are in contact with the slope surfaces, respectively. When the connector and a mating connector are inserted into each other, snap bodies of the fastener and fastener bodies of the mating connector can be snapped into each other to be directly locked. When the connector and the mating connector are to be separated from each other, the outer shell can be rotated to cause the snap bodies to disengage and to cause the push blocks to rotate while in contact with the sloped surfaces to effect ejector rods to move forwardly to eject the mating connector.

9 Claims, 9 Drawing Sheets

(56) References Cited

U.S. PATENT DOCUMENTS 3,368,182 A * 2/1968 Culver ..... H01R 13/6278 439/352
3,475,715 A * 10/1969 Venaleck ..... H01R 13/635 439/159
3,737,835 A * 6/1973 Clement ..... H01R 13/635 439/155
4,045,106 A * 8/1977 Borg ..... H01R 13/635 439/152
4,140,359 A * 2/1979 Kunz ..... H01R 13/633 439/160
4,157,855 A * 6/1979 Chan ..... H01R 13/635 439/155
4,619,492 A * 10/1986 Corblick ..... H01R 13/62 439/153
5,447,443 A * 9/1995 Ramah ..... H01R 13/633 439/159
6,216,195 B1 * 4/2001 Lee ..... G06F 1/1632 361/679.41
6,716,044 B2 * 4/2004 Bertke ..... H01R 13/6335 439/159
6,808,401 B2 * 10/2004 Guzeldereli ..... H01R 13/6335 439/160
7,125,270 B2 * 10/2006 Buck ..... B25F 5/02 439/155
7,628,626 B1 * 12/2009 Tseng ..... H01R 13/6335 439/160
8,764,309 B2 * 7/2014 Wouters ..... G02B 6/3893 385/59
8,771,006 B1 * 7/2014 Blinson ..... H01R 13/6335 439/484
9,437,966 B2 * 9/2016 Gagne ..... H01R 13/7132
9,887,493 B2 * 2/2018 Lee ..... H01R 13/04
10,978,830 B2 * 4/2021 Hammerling ..... H01R 13/6271
2002/0064983 A1 * 5/2002 Patey ..... H01R 13/635 439/152

* cited by examiner

CONNECTOR WITH DIRECT LOCKING AND ROTATIONAL PRE-EJECTION FUNCTION

CROSS-REFERENCE TO RELATED PATENT APPLICATION

This application claims the benefit of priority to China Patent Application No. 202010679930.X, filed on Jul. 15, 2020 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to a connector with a direct locking and a rotational pre-ejection function that can be easily used for two connectors to lock, unlock, and insert into each other.

BACKGROUND OF THE DISCLOSURE

A conventional connector includes a first connector and a second connector. The first connector and the second connector can be disposed on an end of a board and an end of a wire, respectively, and the first connector and the second connector can be inserted into each other to be electrically connected. In order for the first connector and the second connector to be stably connected when being inserted into each other, a lock structure is usually disposed between the first connector and the second connector.

In the related art, triangular buckles can be disposed on the first connector and the second connector, respectively. When the first connector and the second connector are inserted into each other, two triangular buckles slide against each other and generate rotation that compresses an internal compression spring, then an elastic force of the compression spring is utilized such that the two triangular buckles automatically rotate in an opposite direction and recover to the original position, so that the two triangular buckles are locked to each other. However, when separating the first connector and the second connector from each other, the devices can only be rotated in one direction to be unlocked. If the direction of the rotation is incorrect, the devices will not be able to unlock from each other, which can cause inconvenience in use. Conventional connectors that can be unlocked in both directions already exist, and when the first connector and the second connector need to be separated, the devices can be rotated along a clockwise or counterclockwise direction to conveniently perform an unlocking operation. However, the conventional connectors do not have a pre-ejection function that allows a swift and effective separation of the two connectors.

SUMMARY OF THE DISCLOSURE

In response to the above-referenced technical inadequacies, the present disclosure provides a connector with a direct locking and a rotational pre-ejection function having a pre-ejection function, and with which two connectors can be swiftly and effectively separated from each other.

In one aspect, the present disclosure provides a connector with a direct locking and a rotational pre-ejection function. The connector includes an insulated body, a plurality of terminals, an inner shell, an outer shell, a fastener, an ejector, a first elastic element, and a second elastic element. The plurality of terminals are disposed on the insulated body. The inner shell is sleeved on an outside near an end of the insulated body. The outer shell has a cylinder body, and a plurality of push blocks that are disposed in the cylinder body. The outer shell is rotatably sleeved on the insulated body and an outside of the inner shell.

The fastener has a fixing portion and a plurality of snap bodies, the snap bodies are connected to the fixing portion and the fixing portion of the fastener is fixed to the outer shell, so that the fastener is disposed on an inner side of the outer shell. The ejector is disposed between the inner shell and the outer shell, the ejector has an ejector body, at least one ejector rod and a plurality of slope surfaces, the ejector rod is connected to the ejector body, the slope surfaces are disposed on the ejector body, and the push blocks are in contact with the slope surfaces, respectively. The first elastic element abuts against the ejector to provide an elastic force that allows the ejector to recover to its original position, and the second elastic element abuts against the outer shell to provide an elastic force that allows the outer shell to recover to its original position. When the outer shell is rotated along a clockwise or counterclockwise direction, the outer shell can drive the push blocks to rotate, so that the push blocks can push the slope surfaces, respectively. Then the ejector can move in a direction towards a mating connector to eject the mating connector.

Preferably, the push blocks are disposed at intervals, the push blocks are close to an end of the cylinder body, and each of the push blocks has a circular arc surface. The circular arc surfaces of the push blocks face towards the ejector, and the circular arc surfaces of the push blocks are in contact with the slope surfaces, respectively.

Preferably, a snap surface and a guide surface are formed on the snap bodies, the snap surface is in a direction perpendicular to an axial direction of the insulated body, and the guide surface is an inclined surface or an arc surface.

Preferably, the ejector body is ring-shaped, a plurality of the ejector rods are disposed on the ejector body, and the ejector rods are disposed at intervals. A cross-sectional view of the ejector rods is circular arc-shaped, and the ejector rods are arranged in a circle.

Preferably, the ejector rods are connected to an end of the ejector body, and the slope surfaces are disposed on another end of the ejector body. Each of the slope surfaces has two tilted sections, and the two tilted sections are disposed at intervals.

Preferably, a positioning piece is disposed on the inner shell, the positioning piece is positioned on an outer side of the inner shell, and the positioning piece is also positioned on the inner side of the outer shell. A plurality of first through holes are disposed on the positioning piece, so that the snap bodies of the fastener pass through the first through holes, respectively. A second through hole is disposed on the positioning piece, and the ejector rod passes through the second through hole.

Preferably, the first elastic element is a compression spring, and the first elastic element is disposed between the inner shell and the outer shell. An end of the first elastic element abuts against the positioning piece, and another end of the first elastic element abuts against the ejector body.

Preferably, the second elastic element is a torsion spring, the second elastic element is disposed between the inner shell and the outer shell, and two ends of the second elastic element abut against the inner shell and the outer shell.

Preferably, the push blocks are fixed on the fixing portion of the fastener.

A beneficial effect of the present disclosure is that, when the outer shell of the present disclosure is rotated along the clockwise or counterclockwise direction, the outer shell can drive the push blocks to move, so as to push the slope surfaces of the ejector to move the ejector. The ejector then moves in a forward direction and ejects the mating connector. In other words, the connector has a pre-ejection function that can swiftly and effectively separate the two connectors.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
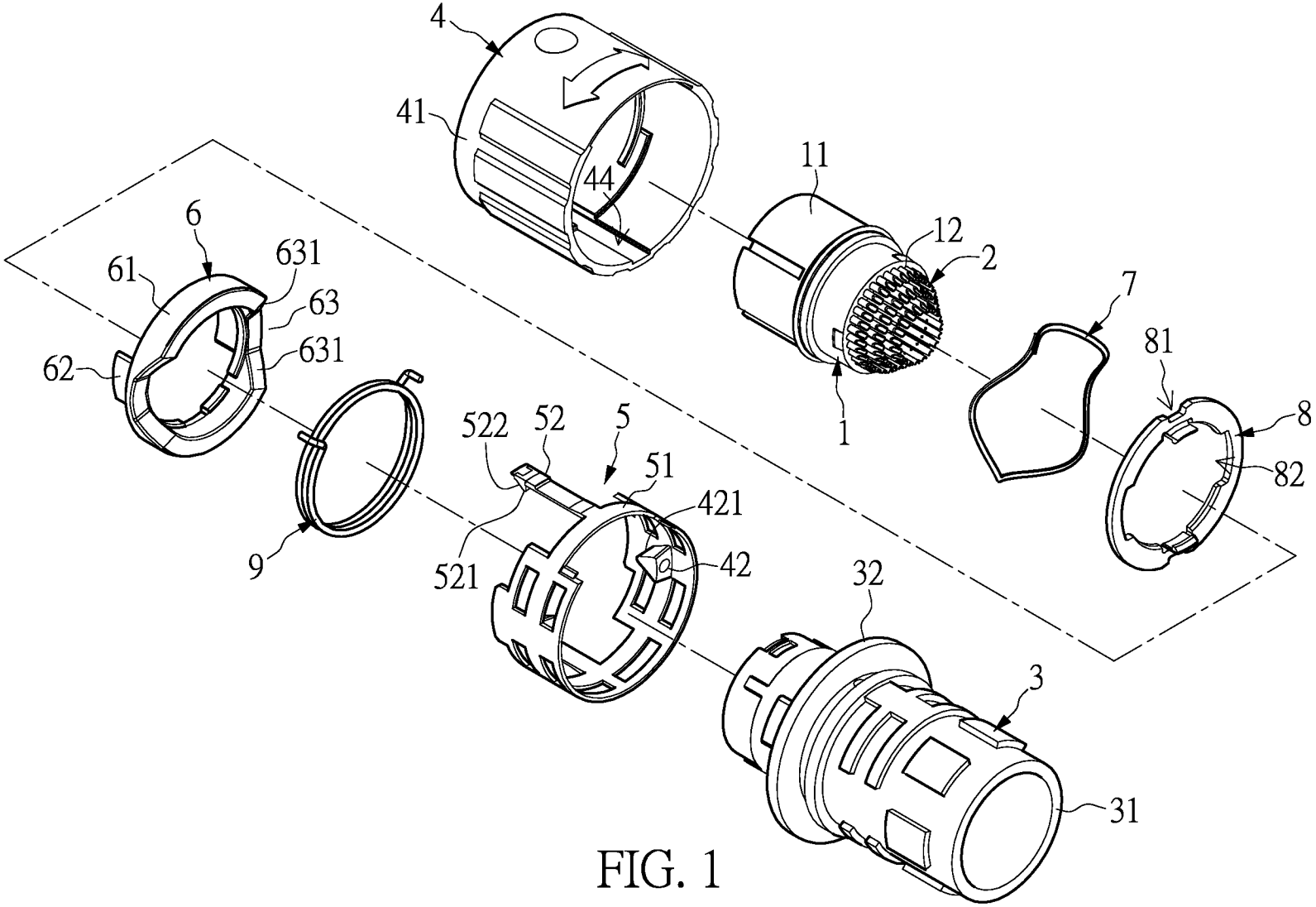
FIG. 1 is a perspective exploded view of a connector of the present disclosure.
Figure 2:
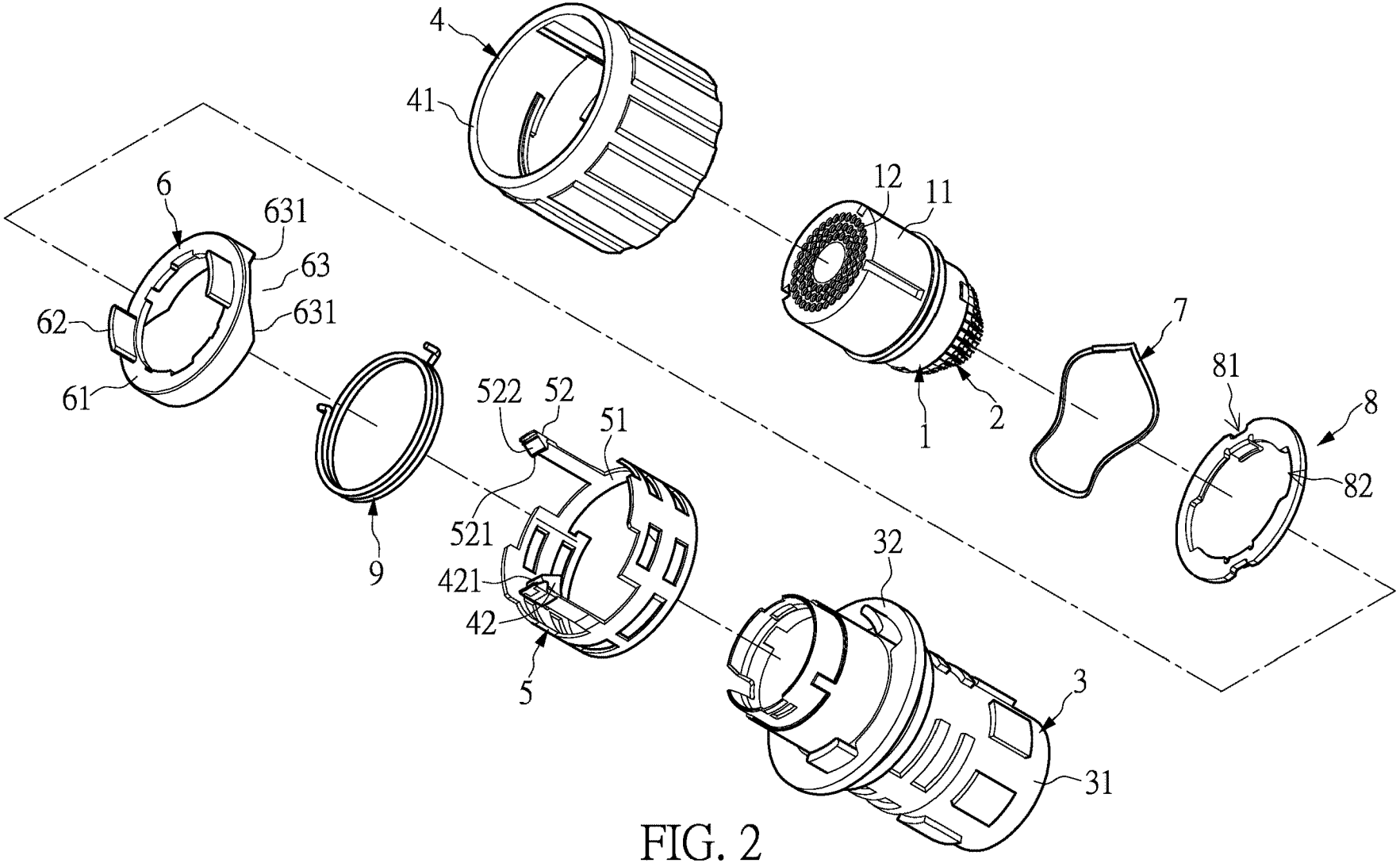
FIG. 2 is another perspective exploded view of the connector of the present disclosure.
Figure 3:
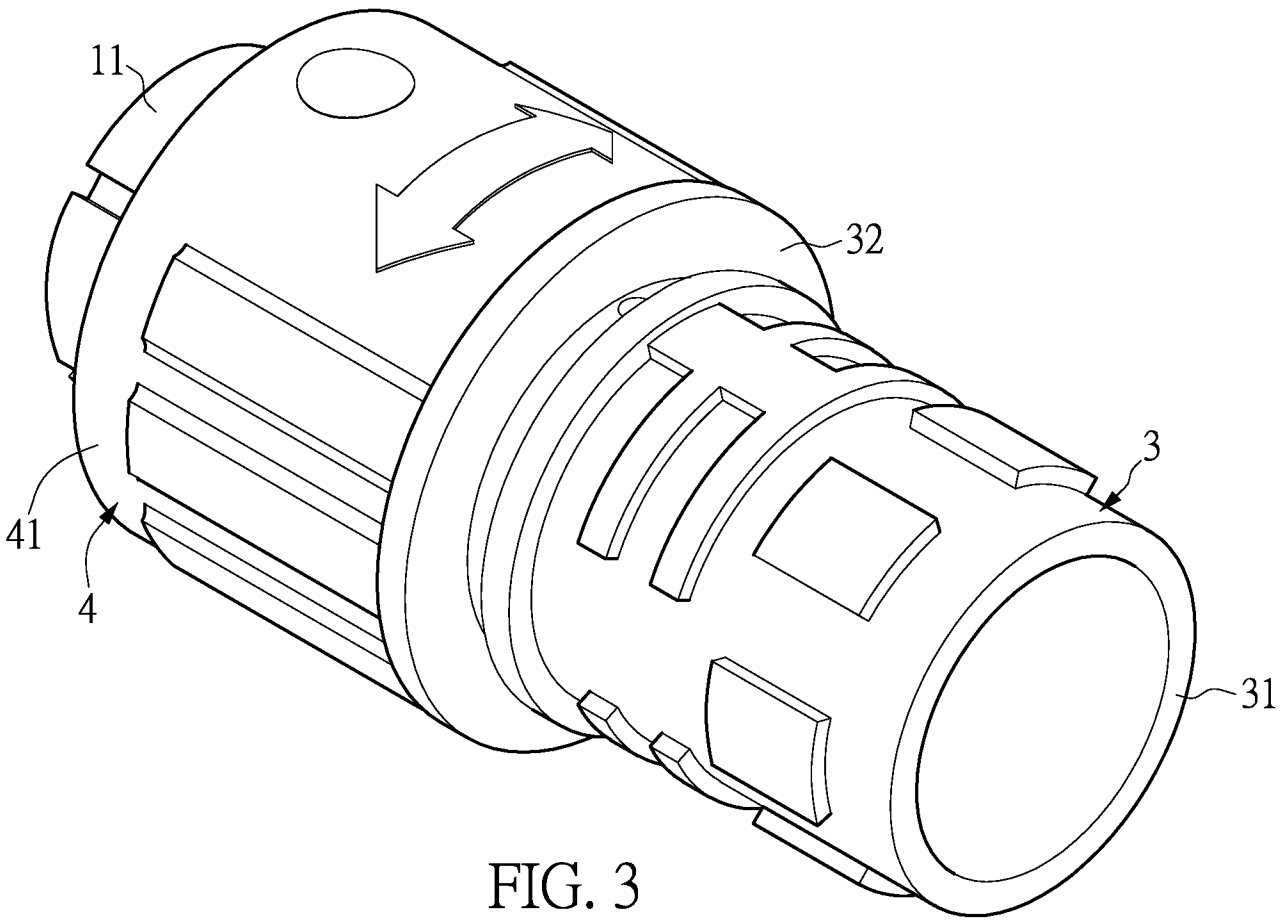
FIG. 3 is a perspective view of the connector of the present disclosure.
Figure 4:
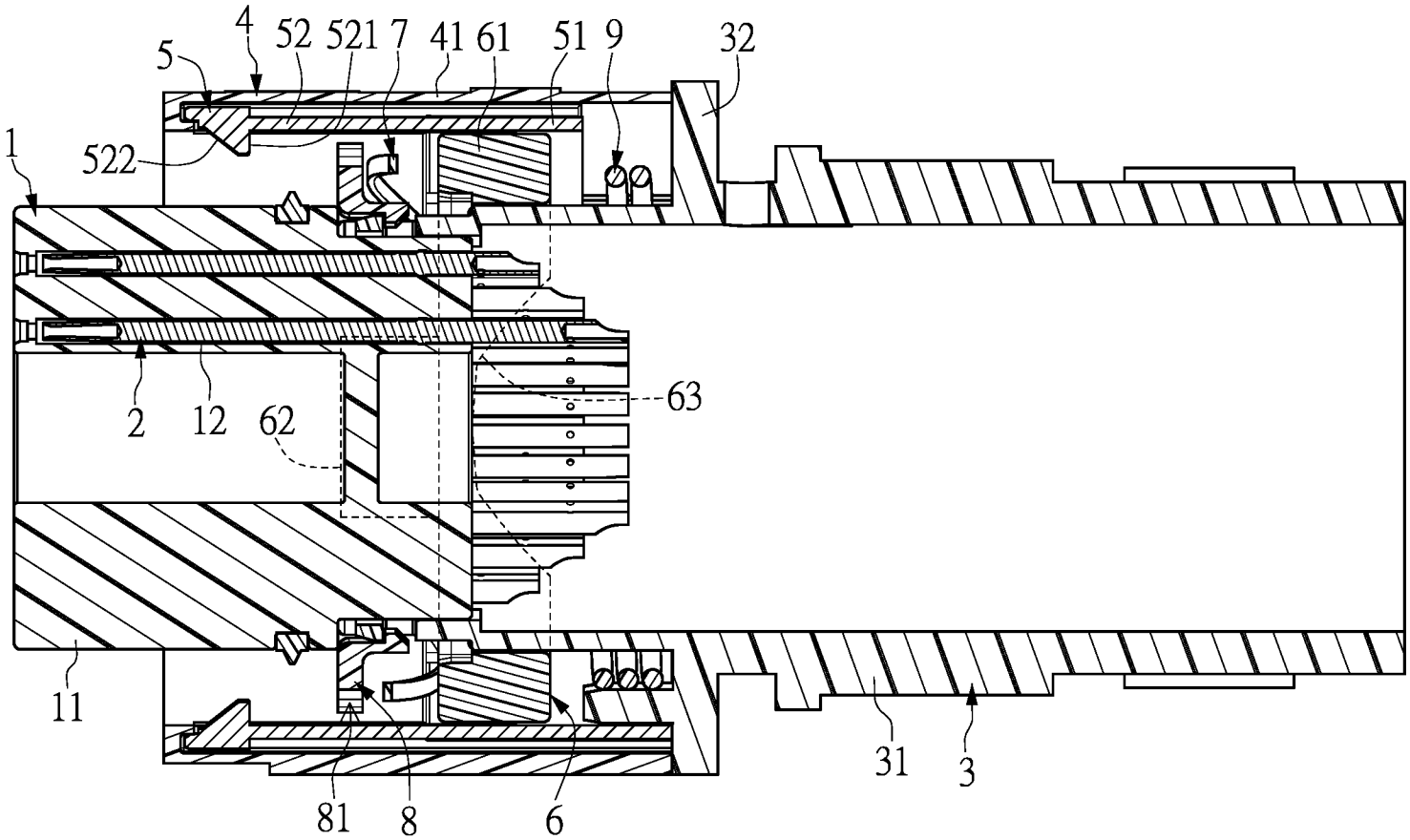
FIG. 4 is a cross-sectional view of the connector of the present disclosure.
Figure 5:
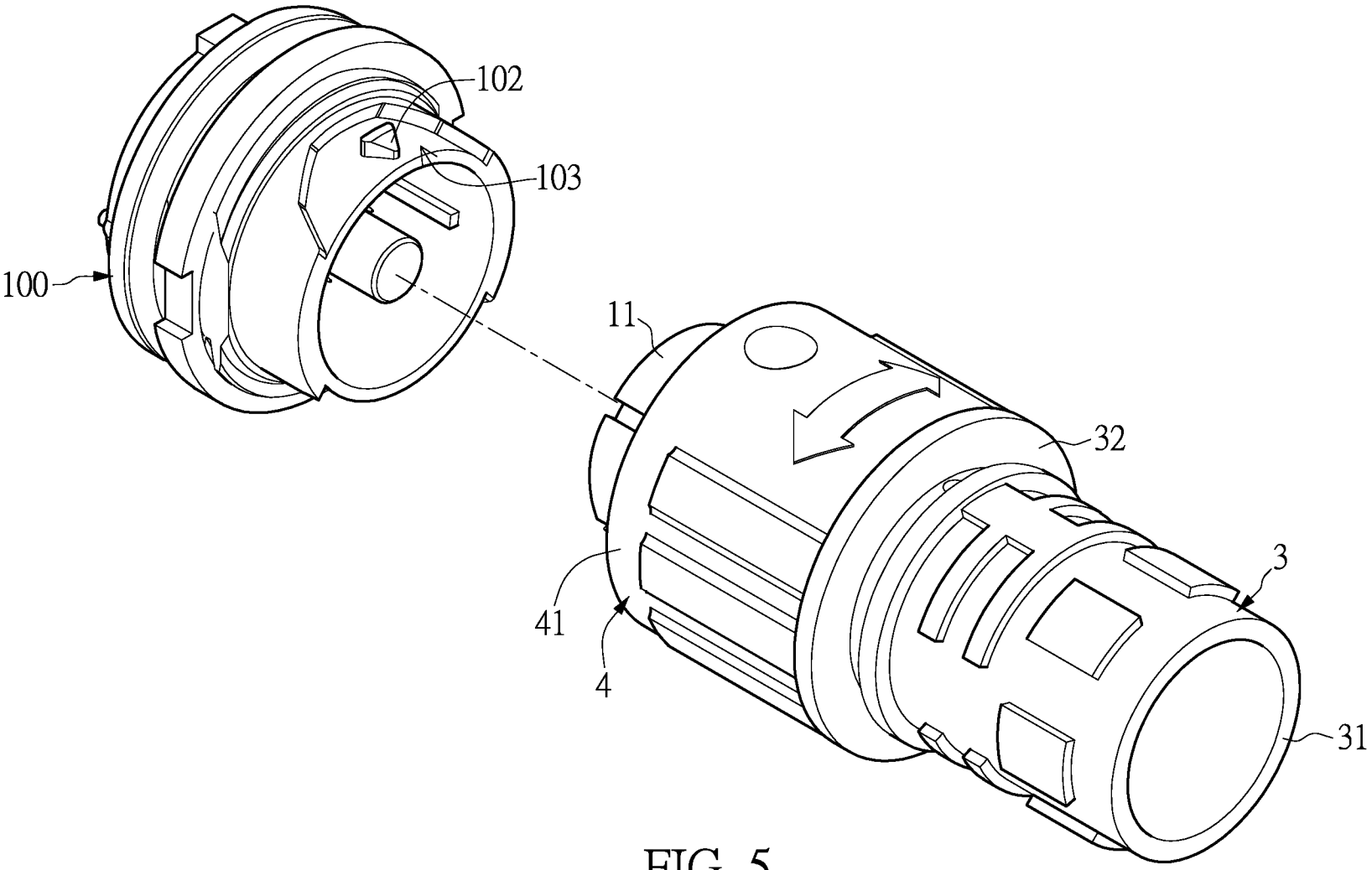
FIG. 5 is a perspective view of the connector and a mating connector in a separated state of the present disclosure.
Figure 6:
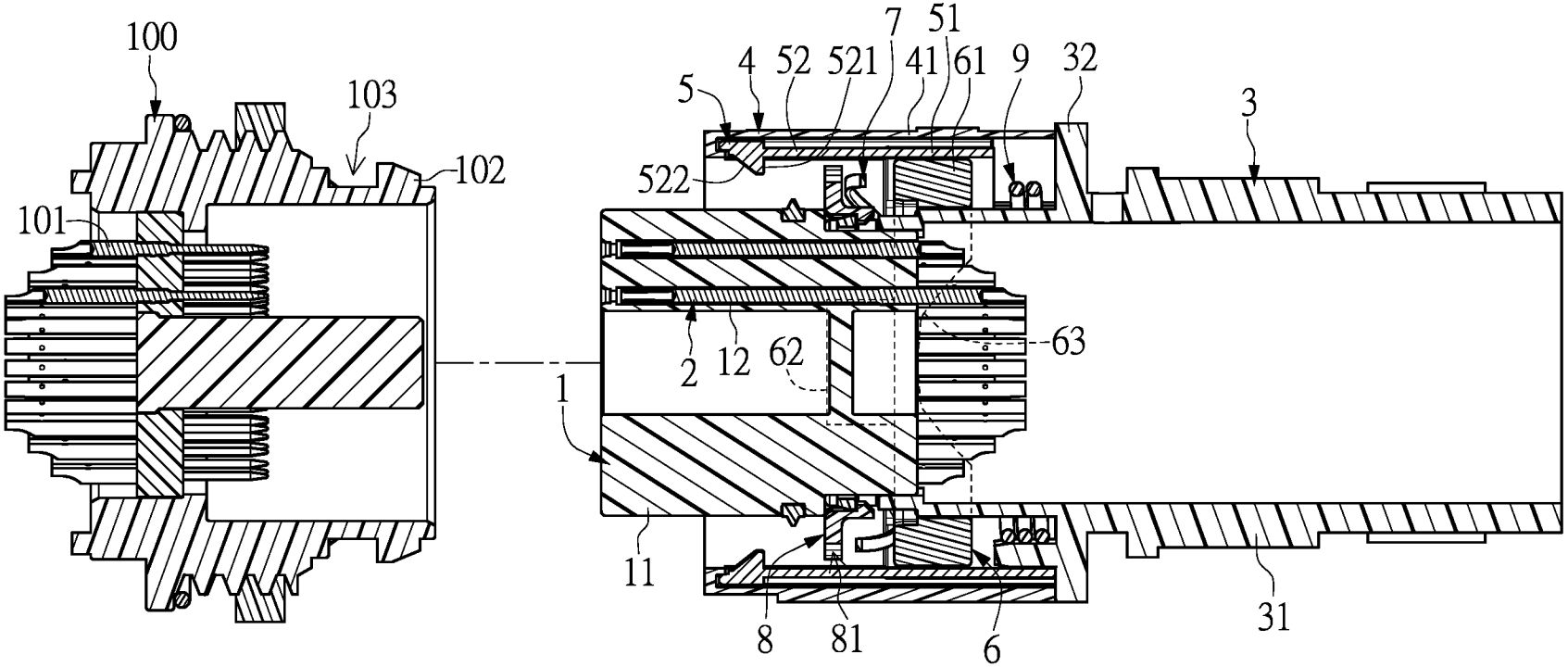
FIG. 6 is a cross-sectional view of the connector and the mating connector in the separated state of the present disclosure.
Figure 7:
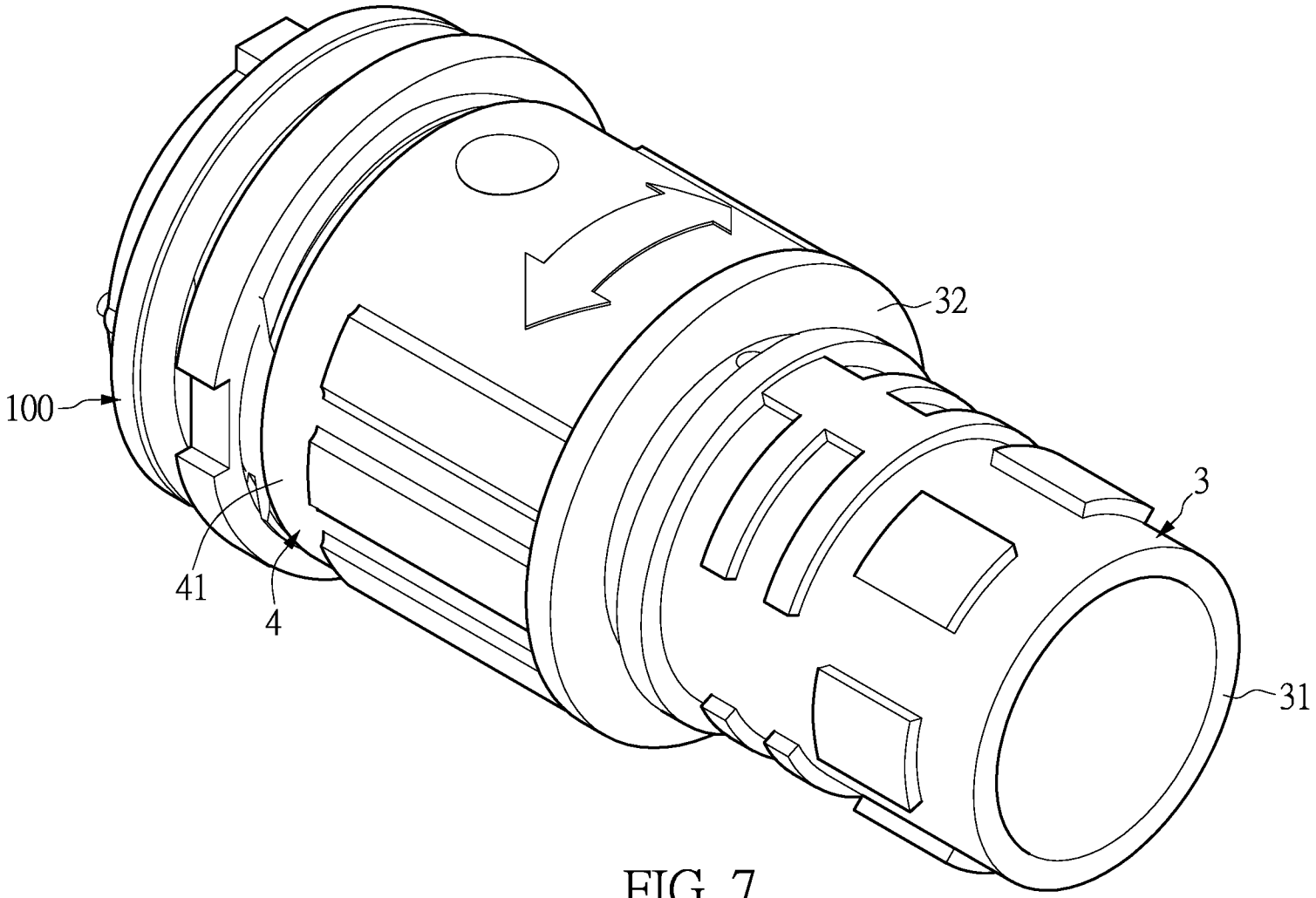
FIG. 7 is a perspective view of the connector and the mating connector in an inserted state of the present disclosure.
Figure 8:
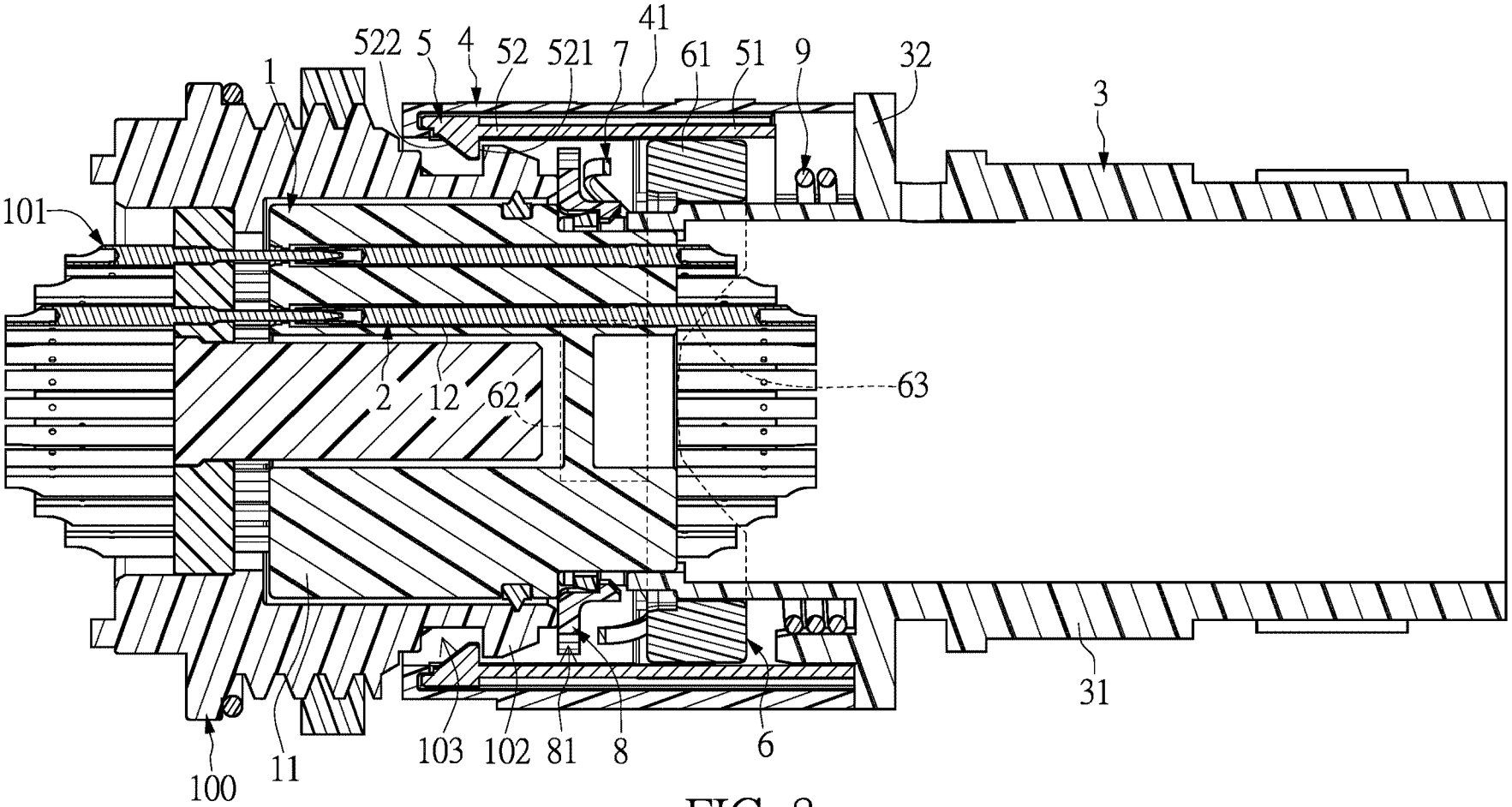
FIG. 8 is a cross-sectional view of the connector and the mating connector in the inserted state of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 4, the present disclosure provides a connector with a direct locking and a rotational pre-ejection function. The connector includes an insulated body 1, a plurality of terminals 2, an inner shell 3, an outer shell 4, a fastener 5, an ejector 6, a first elastic element 7 and a second elastic element 9.

A "front end" described in each component of the present disclosure refers to an end that is close to a mating connector, and a "rear end" refers to an end that is away from the mating connector. That is, an end that faces in an insertion direction is defined as the "front end", and an end that faces away from the insertion direction is defined as the "rear end".

The insulated body 1 is made of plastic material, which is an insulator. The insulated body 1 can have a body portion 11 and a plurality of terminal holes 12. The body portion 11 can be cylindrical. The terminal holes 12 are disposed on the body portion 11, and the terminal holes 12 penetrate through two ends (front end and rear end) of the body portion 11, so as to have the terminals 2 assembled thereto.

The terminals 2 are made of conductive metal materials, and the terminals 2 are disposed on the insulated body 1. The terminals 2 can be used as power terminals, signals powers, etc. The terminals 2 are assembled to the terminal holes 12, respectively, so that the terminals 2 are disposed on the insulted body 1. Rear ends of the terminals 2 can extend through a rear end of the insulated body 1, so as to conveniently be electrically connected to cables and other devices.

The inner shell 3 is made of plastic material, which is an insulator. The inner shell 3 can have an inner shell body 31 and a ring body 32, the inner shell body 31 has a hollow body, and the inner shell body 31 can be cylindrical. The ring body 32 is fixed on an outer side of the inner shell body 31, and the ring body 32 protrudes from the outer side of the inner shell body 31. The inner shell 3 is sleeved outside of and near an end (rear end) of the insulated body 1.

The outer shell 4 is made of plastic material, which is an insulator. The outer shell 4 can have a cylinder body 41, the cylinder body 41 is a hollow body, and the cylinder body 41 can be cylindrical. A plurality of push blocks 42 are disposed in the cylinder body 41, and the push blocks 42 are disposed at intervals. Preferably, the push blocks 42 are fixed on the fastener 5, and each of the push blocks 42 has a circular arc surface 421. The circular arc surfaces 421 of the push blocks 42 faces the ejector 6, that is, the circular arc surfaces 421 faces the insertion direction of the connector, such that the circular arc surfaces 421 face the mating connector. In the present embodiment, the push blocks 42 are close to an end (rear end) of the cylinder body 41. The outer shell 4 is rotatably sleeved on the insulated body 1 and an outside of the inner shell 3, that is, the outer shell 4 is sleeved on an outer side between the insulated body 1 and the inner shell 3.

The fastener 5 has a fixing portion 51 and a plurality of snap bodies 52, the snap bodies 52 are connected to the fixing portion 51, and the snap bodies 52 are of elastic arm structures. The fixing portion 51 of the fastener 5 can be fixed on the outer shell 4, so that the fixing portion 51 of the fastener 5 is fixed on the outer shell 4, and the fastener 5 is disposed on an inner side of the outer shell 4. In the present embodiment, a plurality of accommodating slots 44 are disposed on an inner side of the cylinder body 41, and the accommodating slots 44 correspond to the snap bodies 52, respectively, so that the snap bodies 52 move elastically (inward and outward). In the present embodiment, the push blocks 42 are fixed on the fixing portion 51 of the fastener 5. Preferably, a snap surface 521 is formed on the snap bodies 52, and the snap surface 521 can be in a direction perpendicular to an insert direction of the connector, that is, the snap surface 521 is in a direction perpendicular to an axial direction of the insulated body 1, so that the snap bodies 52 have a greater snapping effect. A guide surface 522 can be formed on the snap bodies 52, and the guide surface 522 can be an inclined surface or an arc surface that is used to guide the snap bodies 52 to successfully snap with the mating connector.

The ejector 6 is disposed in the outer shell 4, the ejector 6 can be disposed in the cylinder body 41 of the outer shell 4, and the ejector 6 can be disposed on the outside of the inner shell 3, so that the ejector 6 is positioned between the inner shell 3 and the outer shell 4. The ejector 6 has an ejector body 61, at least one ejector rod 62 and a plurality of slope surfaces 63. The ejector body 61 can be ring-shaped, a plurality of the ejector rods 62 are preferably disposed on the ejector body 61, and the ejector rods 62 are disposed at intervals. A cross-sectional view of the ejector rods 62 can be circular arc-shaped, so that the ejector rods 62 can be arranged in a circle, so as to apply thrust force evenly to the mating connectors. The ejector rods 62 are connected to the ejector body 61, and can be connected to an end (front end) of the ejector body 61. The ejector rods 62 extend in a forward direction, i.e., extending in the insertion direction (a direction of the mating connector).

Figure 9:
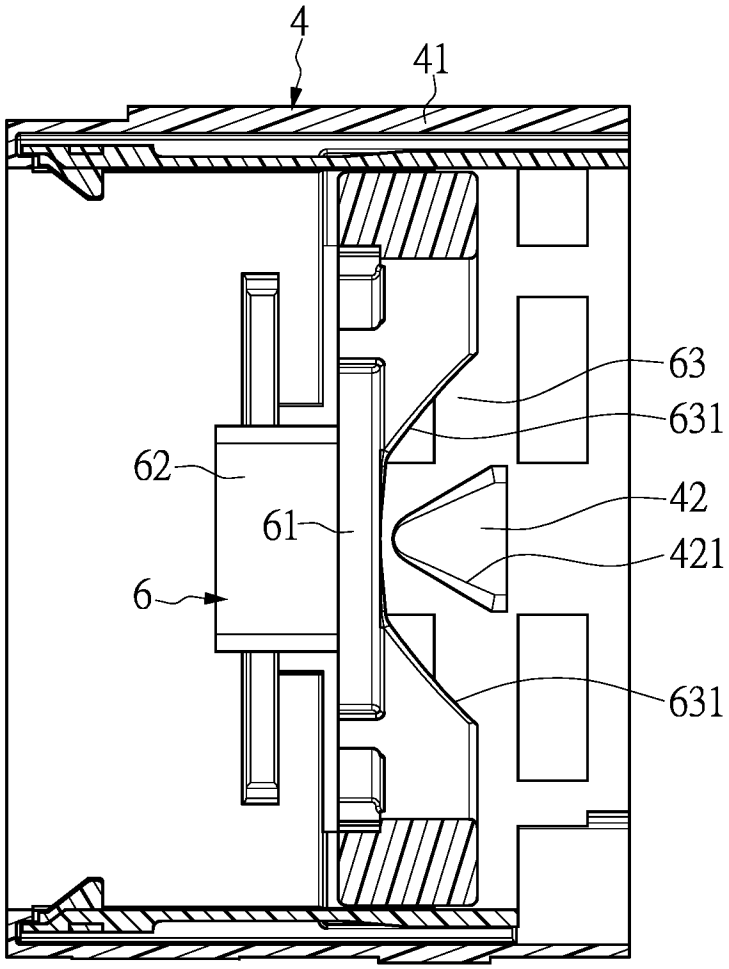
FIG. 9 is a schematic view of a push block being in contact with a slope surface of the present disclosure.

The slope surfaces 63 are disposed on the ejector body 61, and the slope surfaces 63 can be disposed on another end (rear end) of the ejector body 61. The push blocks 42 are in contact with the slope surfaces 63, respectively, (as shown in FIG. 9), that is, the circular arc surfaces 421 of the push blocks 42 are in contact with the slope surfaces 63, respectively. In the present embodiment, the slope surfaces 63 each have two tilted sections 631, and the two tilted sections 631 are disposed at intervals. When the push blocks 42 are positioned between the two tilted sections 631, the ejector 6 can be in a retracted state. When the push blocks 42 move in a direction towards the two tilted sections 631, the ejector 6 will gradually extend forward.

When the outer shell 4 is rotated along a clockwise or counterclockwise direction, the outer shell 4 can drive the push blocks 42 to rotate, and the circular arc surfaces 421 of the push blocks 42 can push the slope surfaces 63, so that the ejector 6 can move forward. That is, the ejector 6 can move in a direction towards the mating connector, to eject the mating connector to achieve a pre-ejection function.

In the present embodiment, a positioning piece 8 can be disposed on the inner shell 3, the positioning piece 8 is positioned on an outer side of the inner shell 3, the positioning piece 8 is also positioned on the inner side of the outer shell 4, and the positioning piece 8 can be fixed onto the outer side of the inner shell 3 in a snapping manner. A plurality of first through holes 81 are disposed on the positioning piece 8, the snap bodies 52 of the fastener 5 pass through the first through holes 81, respectively. A plurality of second through holes 82 are disposed on the positioning piece 8, the ejector rods 62 pass through the second through holes 82, respectively, so that the ejector rods 62 can extend forward through the second through holes 82, to eject the mating connector.

The first elastic element 7 abuts against the ejector 6 to provide an elastic force that allows the ejector 6 to recover to its original position. The first elastic element 7 can be a compression spring, and the first elastic element 7 can be disposed between the inner shell 3 and the outer shell 4. An end of the first elastic element 7 can abut against the positioning piece 8, and another end of the first elastic element 7 can abut against the ejector body 61, so that the first elastic element 7 can push the ejector 6 to move and recover.

The second elastic element 9 abuts against the outer shell 4 to provide an elastic force that allows the outer shell 4 to recover. The second elastic element 9 can be a torsion spring, and the second elastic element 9 can be disposed between the inner shell 3 and the outer shell 4. Two ends of the second elastic element 9 can abut against the inner shell 3 and the outer shell 4, so that the second elastic element 9 can push the outer shell 4 to rotate and recover.

Referring to FIG. 5 to FIG. 8, a connector of the present disclosure that can be inserted into a mating connector 100 is shown. The mating connector 100 has a plurality of mating terminals 101 and a plurality of fastener bodies 102, and a groove 103 is disposed on an outer side of the fastener bodies 102. When the connector of the present disclosure and the mating connector 100 are inserted into each other, the terminals 2 and the mating terminals 101 are in contact and electrically connected with each other, and the snap bodies 52 and the fastener bodies 102 can be snapped into each other. That is, the snap bodies 52 can slide outward past the fastener bodies 102, so that the snap bodies 52 are snapped into a rear end of the fastener bodies 102 to achieve a direct locking effect. At this time, the snap bodies 52 are positioned at the groove 103 at a back side of the fastener bodies 102.

When the connector of the present disclosure and the mating connector 100 are to be separated from each other, the outer shell 4 can be rotated along the clockwise or counterclockwise direction. The snap bodies 52 can slide to a position near a side (left side or right side) of a rear end of the groove 103, and the snap bodies 52 can slide to a front end of the groove 103, so that the snap bodies 52 are separated from the fastener bodies 102 to achieve an unlocking effect. When the outer shell 4 of the present disclosure rotates in a left or right direction, the snap bodies 52 can each exit outward through the groove 103 to achieve a bi-directional unlocking effect.

When the connector of the present disclosure and the mating connector 100 are to be separated from each other, the outer shell 4 can be rotated along the clockwise or counterclockwise direction. At this time, the outer shell 4 can drive the push blocks 42 to rotate, and the push blocks 42 can push the slope surfaces 63, respectively, so that the ejector 6 can move forward to use the ejector rods 62 to eject the dock connector 100 through the pre-ejection function.

A beneficial effect of the present disclosure is that, when the connector of the present disclosure and the mating connector are to be separated from each other, the outer shell can be rotated along the clockwise or counterclockwise direction, so that the snap bodies of the fastener and the fastener bodies of the mating connector can be separated from each other to achieve the unlocking effect, in which the connector of the present disclosure can be unlocked in the bi-directional directions, to conveniently perform an unlocking operation. Furthermore, when the outer shell is rotated along the clockwise or counterclockwise direction, the outer shell can drive the push blocks to move, so as to push the slope surfaces of the ejector to move the ejector, respectively. The ejector then moves in a forward direction and ejects the mating connector with the pre-ejection function, so as to allow a swift and effective separation of the two connectors.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A connector with a direct locking and a rotational pre-ejection function, comprising:

an insulated body;

a plurality of terminals, the terminals being disposed on the insulated body;

an inner shell, the inner shell being sleeved outside of and near an end of the insulated body;

an outer shell, the outer shell having a cylinder body, a plurality of push blocks being disposed in the cylinder body, and the outer shell being rotatably sleeved on the insulated body and an outside of the inner shell;

a fastener, the fastener having a fixing portion and a plurality of snap bodies, the snap bodies being connected to the fixing portion, and the fixing portion of the fastener being fixed to the outer shell, so that the fastener is disposed on an inner side of the outer shell;

an ejector, the ejector being disposed between the inner shell and the outer shell, the ejector having an ejector body, at least one ejector rod and a plurality of slope surfaces, the ejector rod being connected to the ejector body, the slope surfaces being disposed on the ejector body, and the push blocks being in contact with the slope surfaces, respectively;

a first elastic element, the first elastic element abutting against the ejector to provide an elastic force that allows the ejector to recover; and a second elastic element, the second elastic element abutting against the outer shell to provide an elastic force that allows the outer shell to recover;

wherein when the outer shell is rotated along a clockwise or counterclockwise direction, the outer shell drives the push blocks to rotate, and the push blocks push the slope surfaces, respectively, so that the ejector moves in a direction toward a mating connector to eject the mating connector.

2. The connector according to claim 1, wherein the push blocks are disposed at intervals, the push blocks being close to an end of the cylinder body, and each of the push blocks having a circular arc surface, wherein the circular arc surfaces of the push blocks face towards the ejector, and the circular arc surfaces of the push blocks are in contact with the slope surfaces, respectively.

3. The connector according to claim 1, wherein a snap surface and a guide surface are formed on the snap bodies, the snap surface being in a direction perpendicular to an axial direction of the insulated body, and the guide surface being an inclined surface or an arc surface.

4. The connector according to claim 1, wherein the ejector body is ring-shaped, and a plurality of the ejector rods are disposed thereon, wherein the ejector rods are disposed at intervals, a cross-sectional view of the ejector rods is circular arc-shaped, and the ejector rods are arranged in a circle.

5. The connector according to claim 1, wherein the ejector rods are connected to an end of the ejector body, and the slope surfaces are disposed on another end of the ejector body, and wherein each of the slope surfaces has two tilted sections, and the two tilted sections are disposed at intervals.

6. The connector according to claim 1, wherein a positioning piece is disposed on the inner shell, the positioning piece being positioned on an outer side of the inner shell, and the positioning piece also being positioned on the inner side of the outer shell, wherein a plurality of first through holes are disposed on the positioning piece, and the snap bodies of the fastener passes through the first through holes, respectively, and wherein a second through hole is disposed on the positioning piece, and the ejector rod passes through the second through hole.

7. The connector according to claim 6, wherein the first elastic element is a compression spring, the first elastic element being disposed between the inner shell and the outer shell, and wherein an end of the first elastic element abuts against the positioning piece, and another end of the first elastic element abuts against the ejector body.

8. The connector according to claim 1, wherein the second elastic element is a torsion spring, the second elastic element being disposed between the inner shell and the outer shell, and wherein two ends of the second elastic element abut against the inner shell and the outer shell.

9. The connector according to claim 1, wherein the push blocks are fixed on the fixing portion of the fastener.

* * * * *